United States Patent [19]

McCraw

[11] 4,103,894

[45] Aug. 1, 1978

[54] DISK ROLLING GAME OF VARIABLE DIFFICULTY

[75] Inventor: Dan McCraw, Hot Springs, Ark.

[73] Assignee: Domination Incorporated, Hot Springs, Ark.

[21] Appl. No.: 800,806

[22] Filed: May 26, 1977

[51] Int. Cl.[2] ..... A63F 3/00

[52] U.S. Cl. ..... 273/126 A; 273/127 B; 273/1 M; 273/128 A

[58] Field of Search ..... 273/126 R, 126 A, 85 R, 273/127 R, 127 B, 108, 14, 125 R, 116, 123 R, 123 A, 178 R, 118 R, 118 A, 95 R, 95 G, 101, 105, 105.2, 119 R, 119 A, 120 R, 120 A

[56] References Cited

U.S. PATENT DOCUMENTS

| | | | |
|---|---|---|---|
| 569,140 | 10/1896 | Nurick | 273/105 R |
| 751,070 | 2/1904 | Goff | 273/123 R |
| 1,174,411 | 3/1916 | Halton | 273/123 R |
| 1,682,279 | 8/1928 | Hilpert | 273/126 R |
| 2,092,209 | 9/1937 | Gable | 273/126 R |
| 2,238,703 | 4/1941 | McIves et al. | 273/126 R |
| 3,090,622 | 5/1963 | Sire | 273/126 A |
| 3,135,514 | 6/1964 | Ahrent | 273/126 R |
| 3,232,619 | 2/1966 | Burk | 273/126 R |
| 3,323,799 | 6/1967 | Chavez | 273/105.2 |
| 3,386,737 | 6/1968 | Burgess | 273/126 R |
| 3,425,694 | 2/1969 | Norris | 273/126 A |
| 3,451,682 | 6/1969 | Trimble | 273/127 R |
| 3,647,216 | 3/1972 | Breslow | 273/123 R |
| 3,653,665 | 4/1972 | Wahlberg | 273/125 R |
| 3,731,930 | 5/1973 | Jeandron | 273/105 R |
| 3,807,738 | 4/1974 | Breslow | 273/120 R |
| 3,909,006 | 9/1975 | Arbaugh | 273/127 B |

*Primary Examiner*—Richard C. Pinkham
*Assistant Examiner*—T. Brown
*Attorney, Agent, or Firm*—Stephen D. Carver

[57] ABSTRACT

A game playable by one or more players in which the level of skill necessary for success may be selectively varied. The game a disk-shaped piece for each of the players, a fortress structure which may serve as a target depending upon player strategy, a plurality of cup-shaped traps disposed around the fortress for blocking or confining pieces, and a plurality of magnetic parasites for affecting travel of pieces moving in close proximity thereto. The fortress is preferably in the form of a truncated cone of polygonal cross section, and it includes an upper, generally planar safe area adapted to receive pieces. Nubs provided around the safe area circumference may be oriented as desired to vary the level of difficulty by rotating the fortress. The difficulty level is further responsive to variations in fortress height, deployment of additional nubs, and optional use of a fence. Strategy involves wounding of opposing players by contacting their pieces with one's own.

18 Claims, 9 Drawing Figures

Fig. 1.
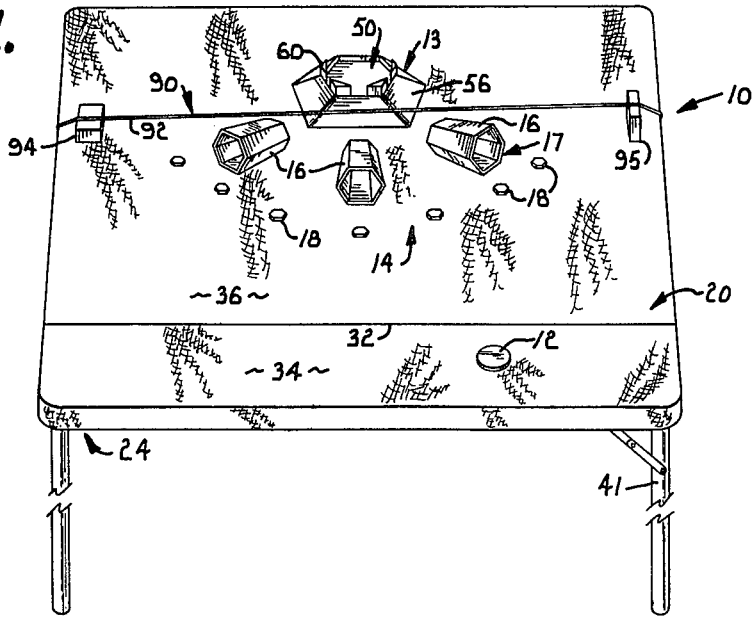
Fig. 2.
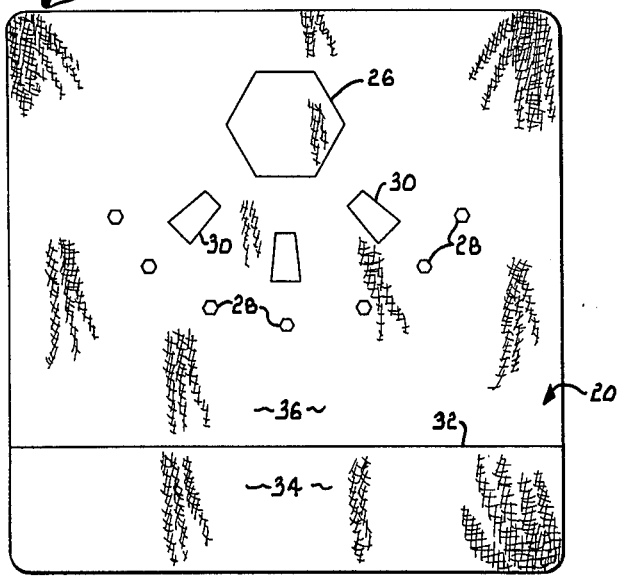
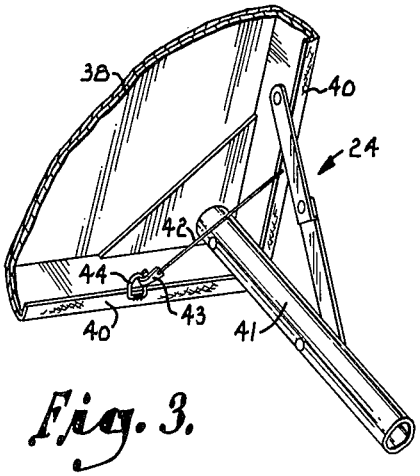
Fig. 3.
Fig. 4.
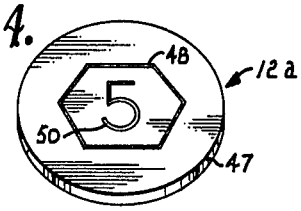
Fig. 5.
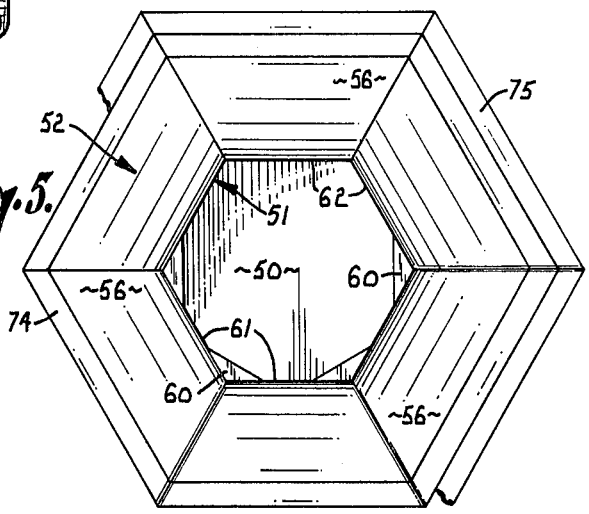

DISK ROLLING GAME OF VARIABLE DIFFICULTY

BACKGROUND OF THE INVENTION

This invention relates to surface projectile games. More particularly, the instant invention relates to games in which pieces may be rolled by the players toward a centrally disposed target structure.

The prior art abounds with examples of games in which a centrally disposed geometric figure provides a target for projectiles such as spheroids, disks, or the like. Examples of known prior art patents relevant to the instant invention are as follows: U.S. Pat. Nos. 3,807,738, issued Apr. 30, 1974 to J. D. Breslow; 751,070, issued Feb. 2, 1904 to T. E. Goff; 1,174,411, issued Mar. 7, 1916 to H. J. Halton; 3,232,619, issued Feb. 1, 1966 to M. Burk; 3,653,665, issued Apr. 4, 1972 to E. C. Wahlberg; and, 3,637,214, issued Jan. 25, 1972 to Glass et. al.

U.S. Pat. Nos. 3,647,216 issued May 7, 1972 to J. D. Breslow and 1,287,903 issued Dec. 17, 1918 to R. T. Daily are representative of prior art devices employing a target in the form of a truncated cone having an upper recess defined therein for selectively admitting projectiles such as balls or the like. A variation of the latter theme believed relevant to the instant invention is shown in U.S. Pat. No. 569,140, issued Oct. 6, 1896 to A. Nurick. The latter invention comprises a fortress structure having a plurality of projectile admitting recesses.

Games involving rolling objects such as disks are shown in the following U.S. Pat. Nos. 1,682,279, issued Aug. 28, 1928 to M. Hilpert; 2,092,209, issued Sept. 7, 1937 to O. R. Gable; 2,238,703, issued Apr. 15, 1941 to J. K. McKiver; 3,135,514, issued June 2, 1964 to D. W. Ahrent; 3,323,799, issued June 6, 1967 to P. G. Chavez; and 3,386,737, issued June 4, 1968 to R. H. Burgess. Examples of games involving magnetic disks can be seen in U.S. Pat. Nos. 3,090,622 issued May 21, 1963 to E. M. Sire, and 3,425,694 issued Feb. 4, 1969 to E. O. Norris.

One problem inherent in most prior art games is that players may rapidly gain the additional skill needed to master the game. Once this happens interest in the game will of course decline. Another problem with prior art games results from the fact that it is difficult if not impossible to accomodate varying numbers of participants. Where an amusement game provides entertainment at a party, for example, either an excess or shortage of interested guests may cause the host dismay.

When a game is especially difficult to play initially it will be of little use. On the other hand, if the game is too easy to learn initially, players will quickly master the game and boredom and disinterest will result. Where a game is designed primarily for children the level of difficulty may be too inconsequential to entertain adults. Conversely, where a game is designed primarily for adults it may be too difficult for children. It thus seems desireable to provide a system whereby the level of skill needed to play or master a game may be varied as necessary to suit the players.

BRIEF SUMMARY OF THE INVENTION

The instant invention comprises a game playable by one or more players in which the level of skill required for mastery of the game may be adjusted.

In a preferred form the game apparatus comprises a disk shaped piece for each of the players, each piece preferably bearing an identification number assigned to each player. A fortress structure disposed upon a supporting surface provided by a card table or the like includes a "safe" area, access to which is provided via a wall which upwardly extends from the supporting surface. Pieces reaching the safe area are immune from further attack or assault by the pieces from opposing players. A plurality of cup-shaped traps substantially larger than the pieces are disposed at predetermined locations around the fortress. Pieces may be admitted into the traps and confined thereby, giving opposing players the opportunity of inflicting a multiple wound. A plurality of magnetic parasites provide a further obstacle to wandering pieces. The parasites may become attached to pieces which venture too close, thereby affecting the course and ultimate destination of same. The parasites provide elements of attack strategy for more advanced players.

It has been found desirable to provide means whereby the level of difficulty may be varied. For example, the requisite skill level may be adjusted downwardly to accomodate children, or it may be increased significantly to stimulate intense adult competition. In either case as the players continue with the game their gradually increasing proficiency may be countered by corresponding increases in the skill level required for game mastery.

The fortress is preferably provided with a plurality of radially spaced-apart nubs permanently disposed about a preselected portion of the safe area circumference. Each of the nubs provides an obstacle to pieces aimed toward the safe area. By rotating the fortress so that these nubs face away from the players easy access to the safe area is achieved. However, when the fortress is positioned so that one or more of the nubs directly faces the players, the level of skill required for game mastery increases. To avoid being scored upon the first player to shoot may have to seek an alternative target for his piece when entry into the safe area is too difficult for him. In one form of the invention the fortress is provided with extra nubs which may be attached to substantially block access to the safe area.

Other means for varying the required skill level may be provided. One or more of a plurality of shims preferably included with the game may be stacked underneath the fortress to raise the height of the safe area and further impede access thereto. Also, a fence may be suspended across the playing surface to interfere with the passage of pieces. The effectiveness of the fence may be varied by adjusting its height above the playing surface.

In a preferred form of the invention the game includes a playing field comprised of flexible material adapted to be quickly attached to a table. The field provides a playing surface of ideal characteristics, and it may be permanently marked with the proper playing positions of the fortress, the parasites, and the traps disposed thereon. A fault line is preferably marked on the field to indicate where play of the pieces must be commenced.

Thus an important object of this invention is to provide a game in which the level of skill required for mastery may be varied.

A similar object of this invention is to provide a game which may be enjoyed by both adults and children.

Another object of this invention is to provide a game of the character described in which an indeterminate number of participants may be accomodated.

Yet another object of the invention is to provide a game of the character described with several different approaches for varying the level of skill required for game mastery, A still further object is to provide a game suitable for play by families.

Another object of this invention is to provide a game of the character described which is adapted to be played upon conventional card tables or the like.

Another object of this invention is to provide an interesting game in which scoring may occur in a variety of situations.

These and other objects and advantages of this invention, along with features of novelty appurtenant thereto, will appear or become apparent from the following description.

BRIEF DESCRIPTION OF THE DRAWINGS

In the following drawings, which form a part of the specification and are to be construed in conjunction therewith, and in which like reference numerals have been employed throughout to indicate like parts in the various views:

FIG. 1 is a perspective view of the invention showing preferred components in a proper position for commencement of play;

FIG. 2 is a top plan view of the playing field showing the marking indicia preferably permanently marked thereon;

FIG. 3 is a perspective view taken from a position underneath a card table, showing how the playing field is preferably attached to the card table or the like;

FIG. 4 is a perspective view of an alternative embodiment of a piece;

FIG. 5 is a top plan view of the fortress showing portions of the optional shims;

DETAILED DESCRIPTION OF THE DRAWINGS

Figure 6:
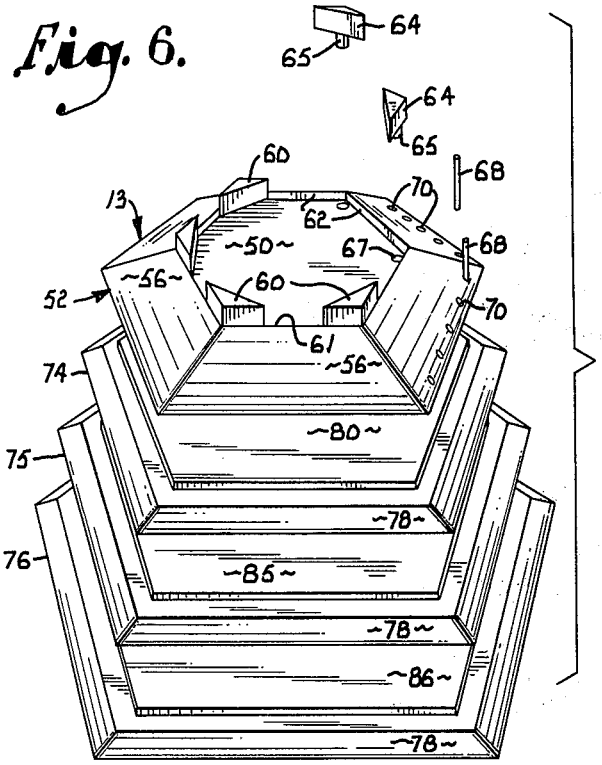
FIG. 6 is an exploded perspective view of the fortress showing placement of the extra nubs and optional shims which may be added to increase the level of skill required for game mastery.

With initial reference to FIG. 1, a game 10 thereshown is constructed in accordance with the teachings of this invention. Game 10 preferably comprises a plurality of disk-like pieces similar to piece 12, a fortress structure 13, and hazard means 14 comprising a plurality of cup-like traps 16 and a plurality of magnetic parasites 18. The aforementioned components are preferably placed upon a playing field 20 which provides a supporting surface and is adapted to be disposed upon a conventional card table 24 or the like. Fortress 13 is preferably centrally disposed within the playing area. Playing field 20 preferably includes a mark 26 (FIG. 2) for locating the fortress, a plurality of marks 28 for locating each of the parasites, and a plurality of marks 30 for indicating the preferred playing position of the traps. It will be apparent that the parasites are preferably disposed at radially spaced-apart locations around the fortress. Traps 16 are also disposed at radially spaced-apart locations around the fortress, but are preferably located between the fortress and the parasites. It will of course be apparent that the fortress, the traps, and/or the parasites may be positioned in alternative positions when desired by the players.

The field is also marked with a fault line 32 which divides it into a first region 34 in which play of the pieces must be commenced, and a second region 36 in which the fortress and other parts of the game are normally located.

The playing field is preferably comprised of soft, flexible material such as cotton cloth, plastic or the like. The field is adapted for placement upon a table 24 providing a supporting surface 38 at the top thereof. The game 10 may alternatively be played upon tabletop 38 without the field. It should be apparent that a wide variety of tables can be employed advantageously with the game 10. The playing field edges 40 extend downwardly about the table edges, and may be connected together to secure the field by an eleastic cable 42. The cable extends between adjacent field edges near the top of the table leg 41. One end of cable 42 is provided with a hook 43 which may be attached to a clevis structure 44 attached to the adjacent field edge (FIG. 3). When all of the playing field cables are similarly fastened the field will be securely fastened to the table (or other supporting suface).

Each player receives a piece 12 which is preferably of disklike, round construction. The pieces are preferably marked with a player number for identification purposes, or they may be colored differently, for example. A preferred embodiment of a piece is illustrated in FIG. 4. Piece 12A thereshown comprises a circular wafer 47 comprised of iron or steel so that it will be attracted by the magnetic parasites 18. The piece may include an ornamental polygon 48 inscribed or stamped thereon, as well as a player identification numeal 50 marked within polygon 48. It is thus readily apparent that piece 12A is playable by the fifth player in a group. Play and scoring of the pieces will be discussed in detail later. in a section entitled "Rules of Play."

Figure 7:
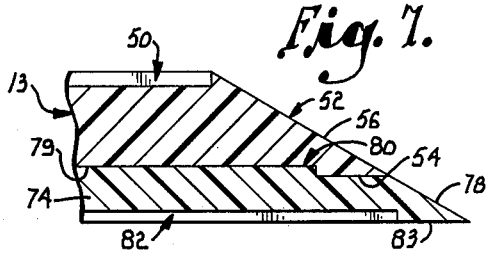
FIG. 7 is a sectional view illustrating how the fortress and the optional shims may be secured together.

Fortress 13 is preferably in the form of a truncated cone of polygonal cross section (FIGS. 1, 5, and 6). The fortress is preferably comprised of plastic or the like, and the base thereof is preferably hexagonal (as illustrated) or octagonal. It will be obvious that the fortress could be shaped in a variety of alternative configuarations. Fortress 13 comprises an upper "safe" area 50, the perimeter or circumference 51 of which adjoins a surrounding wall 52 which slopes downwardly and meets a lower base 54 (FIG. 7). When the fortress is polygonal in cross section the wall 52 will comprise a plurality of generally planar, intersecting ramps 56, the number of which depends upon the fortress shape. It will be apparent that properly aimed pieces may roll up the wall 52 and enter and stop in safe area 50. In a preferred form of the invention the safe area 50 may be recessed slightly to facilitate the landing of pieces.

Figure 9:
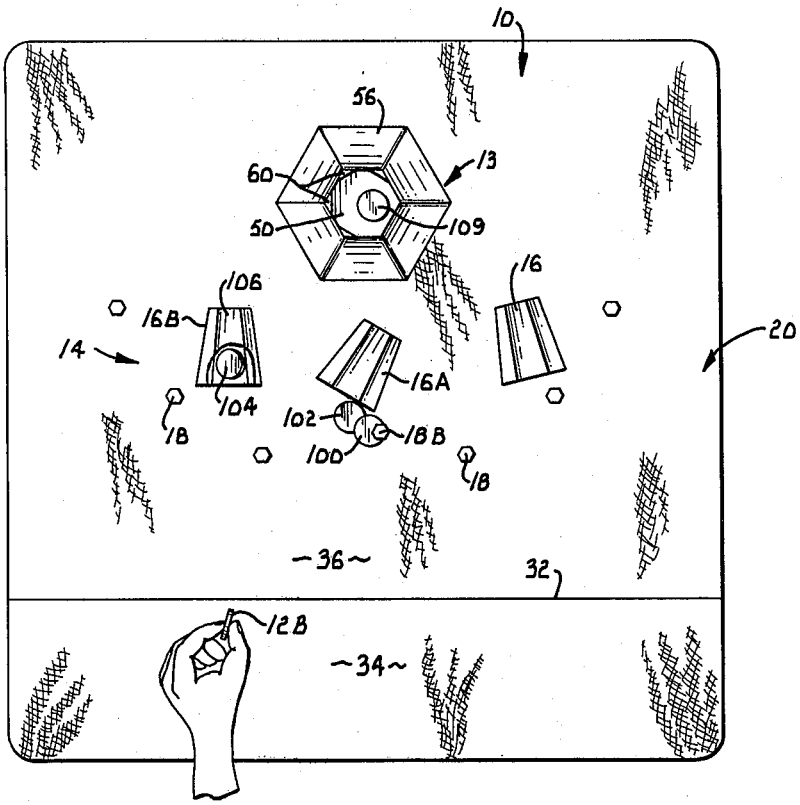
FIG. 9 is a top plan view of the game showing the fortress in a varied position, altered positions of a trap and parasites, possible resting places of a plurality of pieces, and a piece in position to be played.

The fortress 13 comprises a plurality of radially spaced-apart nubs 60 which are preferably integrally formed therewith. These nubs are preferably located about only a portion 61 of the safe area circumference 51. Thus nubs 60 selectively block only a portion of the safe area perimeter. The opposite portion 62 of perimeter 51 is normally unblocked by nubs. It will thus be apparent that by rotating the fortress nubs 60 may be positioned to interfere with pieces seeking to enter space 50, or they may be rotated to the rear of safe area 50 in an "out of the way" position. Thus, by rotating the fortress between the positions illustrated in FIGS. 1 and 9, for example, the level of skill required for mastery of the game 10 can be conveniently varied. The nubs 60 are preferably located at the upper apexes of intersecting ramps 56.

The level of difficulty associated with the game 10 may be further increased by installation of one or more of the extra nubs 64 (FIG. 6). Nubs 64 are shaped the same as nubs 60, except that nubs 64 include an integral, downwardly extending pin 65 adapted to be received within locator holes 67 provided in the normally unblocked portion 62 of the safe area circumference 51. When nubs 64 are installed safe area 50 will be completely encircled by radially spaced-apart nubs, so that access to the safe area will be more difficult. Fortress 13 may also be provided with scoring pins 68 positionable within appropriate scoring holes 70 near the base of the fortress to provide an indication of player scores. Each player will normally be assigned a scoring pin.

The playing skill necessary for game mastery may also be increased by raising fortress height through installation of one or more optional shims 74–76 (FIG. 6,7). Each of the shims is of polygonal cross section matching the fortress shape. Each shim has an inclined wall portion 78 which will line up smoothly with the fortress wall when installed. Since the shims form sections of a truncated cone the lowermost shims will be of gradually increasing dimensions. Fortress height will depend upon the number, if any, of shims used. The higher the fortress the more difficult it becomes to reach the safe area on top.

Referring now to FIG. 7, the fortress 13 may be provided with a lower, centrally located recess portion 79 encircled by the base portion 54. Shim 74 includes an upper, offset portion 80 adapted to fit within recess 79 to secure the shim to the fortress. Shim 74 similarly includes a lower recessed area 82 encircled by shim base 83. Shim 75 will similarly include offset portion 85 to be matingly received within area 82. Shim 76 will include an offset portion 86 receivable within shim 75. In this manner each shim will be secured to the fortress or shim immediately adjoining it. It will be apparent that the shims and the fortress may be locked together by similar alternative techniques.

Parasites 18 are comprised of magnetic material, and are preferably formed in the shape of polygons. The parasites alter the course of pieces travelling in close proximity thereto, and may become attached on a piece coming too close. As will be apparent to those skilled in the art, the latter phenomenom may provide an element of scoring strategy. It will also be apparent that the cup-like traps 16 may alter or influence the course of pieces. The traps are preferably of polygonal cross section similar to the fortress, and they may be comprised of plastic, paper, or the like. The weight of the traps is preferably less than the weight of the pieces so that the traps may be deflected or moved in response to contact with a piece. Each trap includes a mouth 17 (FIG. 1) which is preferably larger than the pieces so that pieces may enter the traps. As will be discussed in more detail later, the admission of a piece into a trap provides an opportunity for an assaulting player to score double (or triple) points when his piece enters a previously occupied trap.

Figure 8:
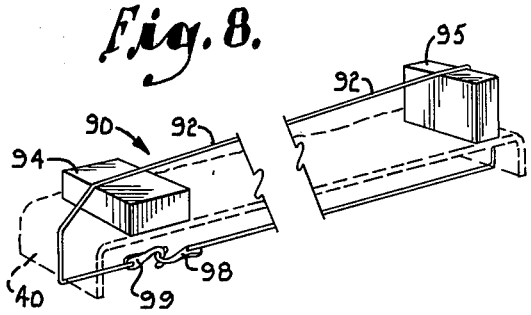
FIG. 8 is a perspective view of the fence apparatus and the fence suspension system.

As best illustrated in FIGS. 1 and 8, game 10 may be provided with a fence structure 90 for altering the level of difficulty associated therewith. The fence structure 90 includes an elongated span 92 which may extend across the playing field or a portion thereof (FIG. 1), and which is supported at opposite ends thereof by fence support bricks 94 and 95. It will be apparent that the fence may be placed at varying locations on the field, and at different offset distances above the playing surface. The fence may simply be placed upon the field surface, or it may be offset from the field by varying the orientation of the support bricks 94 and 95. For example, the fence span 92 may be raised in an amount equal to the thickness of either brick, or it may be suspended a greater distance above the playing surface by placing either or both of the bricks edgewise. The fence may be positioned in its highest orientation by placing the bricks lengthwise. In this manner the game may be made significantly more difficult to play, since the predictable course of pieces will be altered.

The fence span 92 may be comprised of an elastic material such as rubber or the like. The span may be joined at its ends by hooks 98 and 99, and it may extend over the playing surface and underneath the supporting surface (FIG. 8). It is to be understood that game 10 may be played without the fence structure, or with the fence structure oriented in a plurality of alternative positions.

Rules of the Game

A numbered (or colored) piece is first assigned to each of one or more players. A single player may shoot successive pieces where, for example, he wishes to practice. The object of the game is to wound other players (or pieces). Each wound results in assessment of one or more points against the wounded player. The score may be conveniently tabulated with the scoring pins 68. A player receiving an agreed number of wounds is eliminated from the game, and play continues until all but the victorious player are eliminated.

Play of the game is divided into individual battles. Before each battle the fortress, the parasites, and the traps are placed in the proper starting positions illustrated in FIGS. 1 and 2. The level of difficulty of the game may be adjusted as desired by adding nubs or shims to the fortress (FIG. 6), by rotating the fortress (FIGS. 1 and 9), or by erecting the fence structure (FIGS. 1 and 8). Thus central trap 16A in FIG. 9 must be repositioned before starting another battle. During each battle the parasites and the traps are not moved from their starting positions except by movement or contact with the pieces. Any parasite or trap knocked off the field (or supporting surface) remains off the field (or supporting surface) until the next battle. A battle ends whenever a piece receives a wound, and the next battle commences with the wounded player shooting first.

Pieces such as piece 12B (FIG. 9) are played by rolling them on edge, with the roll starting on the proper side of the fault line 32 in area 34. The playing surface is never touched during a battle except to retrieve a piece for its next regular turn. If a trap or parasite must be moved to retrieve a piece it is returned to its starting position before commencement of play. If a parasite is stuck to a piece, that piece must be played with the parasite attached thereto for the remainder of the game, although the affected player may position the parasite on his piece as he sees fit.

A player receives a wound or wounds under the following conditions:

1. If his piece is "covered" in any form by an assaulting piece. Any part of the edge of the assaulting piece must be over (i.e. touching) any part of the edge of the wounded piece for a score to be assessed. Thus in FIG. 9 piece 100 has assaulted and wounded piece 102, and a single point must be scored against the player who shot piece 102. If an assaulting piece ends up under or merely beside another piece a wound does not arise.

2. If the assaulting piece touches another piece in any manner, and either piece has a parasite attached to it, or if the assaulting piece and another piece are touching the same parasite in any manner, all pieces so touched except the assaulting piece are wounded. Thus, if piece 102 were thrown after piece 100, piece 100 would have been wounded by piece 102, since piece 100 has a parasite 18B attached thereto. The latter is true even though piece 100 overlaps piece 102.

3. An assaulting piece falling or rolling off the playing surface is considered wounded.

4. If any piece when played stops in region 34 behind the fault line 32, or stops actually touching the fault line, or if a roll commences in region 36 in front of the fault line, that piece is considered wounded.

5. If a player touches the playing surface or anything on the field except to retrieve his piece for his next regular turn, that player is wounded.

6. If a played piece stops inside a trap, and if the trap is set upright with its mouth edge not touching the playing surface, that piece is wounded. Thus, had piece 104 within trap 16B (FIG. 9) set that trap vertically upright, piece 104 would have received a wound.

7. If a piece stops inside a trap touching only the trap, that piece is vulnerable for a multiple wound, which may be inflicted by an assaulting piece entering the same trap. The trap must remain on the playing surface, otherwise the assaulting piece will be considered wounded. The trap must be completely supporting both pieces. A wounded piece receives three wounds in the central trap 16A (FIG. 9), and only two wounds in either of the other traps. If the trap is set upright by the force of an assaulting player's piece the assaulting piece is not considered wounded. Thus if piece 100 (or piece 102) had entered trap 16B, piece 104 would have had two points assessed against it.

8. Any piece stopping completely inside of the safe area 50 at the top of the fortress, without leaning on the edge of the safe area, is "safe" and cannot be wounded by an assaulting piece. The piece cannot be removed from the safe area until its next turn. Thus piece 109 (FIG. 9) is safe from attack by any assaulting pieces.

After a wound occurs the field is reset for the next battle and the player sustaining the last wound plays first. If that player was eliminated in the last battle, then the next player in numerical order starts the next battle, unless he was the assaulting piece. In the latter case the next player in numerical order plays first. If two or more players were wounded, and two or more were not eliminated from the game, then the assaulting player may choose which of the wounded players opens the next battle.

If one or more parasites has become attached to a piece they must remain attached during the remainder of that battle. However, on his next regular turn that player may rearrange the parasite or parasites on his piece in any manner he should desire. As mentioned earlier, the presence of parasites on one's piece presents a strategic consideration in that the influence through magnetic attraction of the parasite affects the handling and probable resting place of that piece, as well as attracting subsequent assaulting pieces.

While preferred embodiments of the present invention have been described, it should be understood that various changes, adaptations and modifications may be made therein without departing from the spirit of the invention and the scope of the appended claims.

What is claimed is:

1. An amusement game adapted to be played by one or more players, said game comprising:

a plurality of disk-like magnetically attachable game pieces:

a fortress adapted to be disposed upon a supporting surface, said fortress comprising:

a base portion;

a substantially planar safe area in which pieces may be received;

a wall extending around said safe area and above said base; and a plurality of nubs disposed at radially spaced apart locations on at least a portion of said wall and the edge of said safe area for impeding passage of pieces between said wall and into said safe area;

a plurality of cup-like traps for impeding passage of said game pieces which contact same, said traps comprising a mouth portion substantially larger than said game pieces whereby said game pieces may be admitted into said traps; and a plurality of magnetic parasites for altering the course of said game pieces travelling in close proximity thereto.

2. The combination as defined in claim 1 wherein said traps are positioned between said parasites and said fortress on said supporting surface.

3. The combination as defined in claim 2 wherein the mass of said traps is less than the mass of said game pieces whereby said traps are deflectable to alternative positions in response to contact by said game pieces.

4. The combination as defined in claim 1 wherein said game comprises a plurality of shims adapted to be stacked in predetermined quantities under said fortress to thereby raise the height of said fortress, thereby selectively increasing the level of difficulty of said game.

5. The combination as defined in claim 1 wherein said fortress is in the form of a truncated cone of polygonal cross section, and said wall comprises a plurality of intersecting planar ramps sloping downwardly from said safe area to said fortress base.

6. The combination as defined in claim 1 wherein said nubs are disposed about only a preselected portion of said edge, and said game comprises additional nubs adapted to be attached to said fortress about the remaining portion of said safe area edge to selectively increase the level of difficulty of said game.

7. The combination as defined in claim 1 including fence means positionable at a desired location on said supporting surface to interfere with the passage of said game pieces, thereby increasing the level of difficulty of said game.

8. The combination as defined in claim 7 including means for supporting said fence means, said supporting means adapted to be varied in height to thereby vary the effectiveness of said fence means.

9. A game of amusement playable by one or more players comprising:

a playing field adapted to be disposed upon a supporting surface;

a plurality and game pieces for each of said players, at least one said game piece for each of said players;

a fortress adapted to be disposed upon said playing field, said fortress adjustable between positions of varying levels of game difficulty and comprising:

a lower base portion;

an upper, substantially planar safe area in which said game pieces may be received, said safe area comprising a perimeter comprised of a first normally unblocked portion and a second portion;

a wall sloping upwardly and inwardly from said base to define said perimeter of said safe area; and a plurality of nubs disposed at radially spaced-apart locations on said second perimeter portion for impeding the passage of said game pieces said into said safe area; and hazard means disposed upon said field for affecting the path of said game pieces.

10. The combination as defined in claim 9 wherein said game pieces are magnetically attractable and there being a hazard means, said hazard means comprises:

a plurality of cup-like traps disposed at spaced-apart locations around said fortress for impeding the passage of said game pieces, said traps comprising a mouth substantially larger than said game pieces whereby said game pieces may be admitted into said traps; and a plurality of magnetic parasites disposed at spaced-apart locations around said fortress for altering the course of said game pieces travelling in close proximity thereto.

11. The combination as defined in claim 10 wherein said field comprises:

marker means defined thereon for locating the proper playing position of said fortress, said traps, and said parasites; and fault line means for dividing said field into a first area in which play of said game pieces must be commenced and a second area in which said marker means are located.

12. The combination as defined in claim 11 wherein said traps are positioned between said fortress and said parasites.

13. The combination as defined in claim 11 wherein said fortress is in the form of a truncated cone of polygonal cross section, and said wall comprises a plurality of inclined intersecting planar ramps extending between said perimeter and said base.

14. The combination as defined in claim 13 wherein said fortress comprises a plurality of shims adapted to be stacked in predetermined quantities between said base and said field to raise the height of said fortress when desired to increase the level of difficulty of said game.

15. The combination as defined in claim 13 wherein said game comprises additional hubs adapted to be selectively attached to said first portion of said safe area perimeter to selectively increase the level of difficulty of said game.

16. The combination as defined in claim 13 wherein said game comprises fence means selectively positionable at desired locations on said field to further impede the passage of said game pieces to thereby vary the level of difficulty of said game.

17. The combination as defined in claim 16 wherein said game comprises means for supporting said fence means in an offset relationship with respect to said field, said supporting means adapted to be selectively varied in height to thereby vary the effectiveness of said fence means.

18. The combination as defined in claim 14 including means for securely coupling said fortress and said shims with one another.

* * * * *